US010919690B2

(12) United States Patent
Dogan et al.

(10) Patent No.: US 10,919,690 B2
(45) Date of Patent: Feb. 16, 2021

(54) CAPSULE HAVING A MEMBRANE AND METHOD FOR PREPARING A NUTRITIONAL PRODUCT

(71) Applicant: Nestec S. A., Vevey (CH)

(72) Inventors: Nihan Dogan, La Croix-sur-Lutry (CH); Frédéric Doleac, Vaux et Chantegrue (FR); Camille Mesnier, Bouverans (FR)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 15/547,854

(22) PCT Filed: Mar. 30, 2016

(86) PCT No.: PCT/EP2016/056841
§ 371 (c)(1),
(2) Date: Aug. 1, 2017

(87) PCT Pub. No.: WO2016/156343
PCT Pub. Date: Oct. 6, 2016

(65) Prior Publication Data

US 2018/0016092 A1 Jan. 18, 2018

(30) Foreign Application Priority Data

Mar. 31, 2015 (EP) ..... 15161812

(51) Int. Cl.
*B65D 85/804* (2006.01)
*B65D 77/38* (2006.01)

(52) U.S. Cl.
CPC ..... *B65D 85/8043* (2013.01); *B65D 77/38* (2013.01)

(58) Field of Classification Search
None
See application file for complete search history.

(56) References Cited

U.S. PATENT DOCUMENTS

2009/0211458 A1* 8/2009 Denisart ..... B65D 85/8043 99/300
2013/0180409 A1* 7/2013 Dogan ..... B65D 85/8043 99/295
2013/0294711 A1* 11/2013 Stanley ..... B65D 85/00 383/107

FOREIGN PATENT DOCUMENTS

CN 101014513 A 8/2007
EP 2239211A1 A1 10/2010
(Continued)

OTHER PUBLICATIONS

International Search Report, dated May 3, 2016, in PCT/EP2016/056841, filed Mar. 30, 2016.
(Continued)

*Primary Examiner* — Viren A Thakur
*Assistant Examiner* — Thanh H Nguyen
(74) *Attorney, Agent, or Firm* — K&L Gates LLP

(57) ABSTRACT

A capsule for preparing a nutritional product in a device adapted to supply liquid into the capsule is disclosed. The capsule includes at least one compartment for providing nutritional ingredients for the preparation of the nutritional product in combination with the supplied liquid, and the compartment includes a liquid impermeable membrane forming a release side of the compartment. The capsule further includes at least one relief element. Also disclosed is a membrane for use in the manufacture of said capsule. Also disclosed are methods of producing and using the membrane and capsule.

16 Claims, 6 Drawing Sheets

(56) References Cited

FOREIGN PATENT DOCUMENTS

| | | | | |
|---|---|---|---|---|
| WO | 2009115475 | A1 | 9/2009 | |
| WO | WO-2013026651 | A1 * | 2/2013 | ..... B65D 85/8043 |
| WO | 2014037339 | A1 | 3/2014 | |

OTHER PUBLICATIONS

Written Opinion of the International Searching Authority, dated May 3, 2016, in PCT/EP2016/056841, filed Mar. 30, 2016.
CN Application No. 201680015936.9; Nestec. S. A., filed Mar. 30, 2016; Office Action dated Nov. 5, 2018.

* cited by examiner

CAPSULE HAVING A MEMBRANE AND METHOD FOR PREPARING A NUTRITIONAL PRODUCT

CROSS-REFERENCE TO RELATED APPLICATIONS/INCORPORATION BY REFERENCE STATEMENT

This application is a US national stage application filed under 35 USC § 371 of International Application No. PCT/EP2016/056841, filed Mar. 30, 2016; which claims priority to EP App No. 15161812.1, filed Mar. 31, 2015. The entire contents of the above-referenced patent applications are hereby expressly incorporated herein by reference.

TECHNICAL FIELD

The presently disclosed and/or claimed inventive concept(s) relates to a capsule for preparing a nutritional product containing nutritional ingredients by mixing the ingredients with liquids. In particular, the presently disclosed and/or claimed inventive concept(s) relates to a capsule for insertion in a device supplying liquid in the capsule for preparing the nutritional product by mixing with nutritional ingredients—such as infant formula—and having a liquid impermeable membrane which can be pierced by relief elements of the capsule once the nutritional product has been produced in the capsule to release the nutritional product from the capsule.

BACKGROUND

Nutritional compositions can be, for instance, infant formulas or also nutritional liquids for toddlers, invalids, elderly people, persons having nutritional deficiencies or athletes. Food compositions can be, for instance, dairy-based liquids, soup, coffee or tea beverages. These compositions are prepared from ingredients contained in a capsule by addition of a liquid such as hot or ambient water.

These capsules are usually used in devices like beverage preparation machines for domestic use. These machines are designed for preparing a cold or hot nutritional product by interaction of the suitable ingredients provided in the capsule with water supplied by the machine into the capsule. A common principle in these machines is the usage of capsules that comprise a single-dose of the nutritional ingredients for preparing the desired nutritional product. Thereby, usually after placing the capsule into a receiving chamber of the device and enclosing it therein, a liquid like water is injected into the capsule in order to interact, e.g. by means of dissolution and/or extraction with the ingredients of the capsule. The resulting nutritional product is then released or drained from the capsule into a dedicated receiving receptacle placed below the receiving chamber of the machine.

Such capsules may comprise a product delivery system for ensuring a proper interaction of the supplied liquid and the ingredients contained in the compartment of the capsule and for reducing contact of nutritional liquid with the device. The product delivery system is thus designed to open at least one opening through the capsule for delivery of the nutritional product, such as (but not limited to) when a sufficient pressure of liquid has been reached in the compartment. For this, the bottom of the capsule on an outlet side may comprise relief elements strategically placed to perforate a membrane normally separating the compartment from the capsule outlet. This membrane is typically a thin liquid-tight perforable membrane made of aluminum. In certain embodiments, the membrane is sealed at the bottom edge of the capsule and, in certain embodiments, is made of a 30 (20-40) micron foil of aluminum.

Such a capsule is described, for instance, in WO 2010/128028 A1. The mentioned membrane is usually made of aluminum that is sealed at the bottom of the capsules. Aluminum membranes are usually used in the food industry due to their specific functional properties, namely their barrier properties. Also, an aluminum membrane allows for a clear and controlled opening of the membrane with relief elements protruding from an opening wall under the membrane while the use of an aluminum membrane is still critical for the system performance in respect of a sufficient dissolution, a steady flow and anti-splash during opening.

It can be desirable to avoid combination of aluminum and polymeric materials for the making of beverage capsules in order to facilitate/improve recyclability and waste management. However, also plastic membranes that could replace aluminum membranes in single-dose nutritional product systems provide an uncontrolled opening on relief elements once the pressure in the capsule increases thus resulting in the plastic membrane to excessively or uncontrollably tear so that the liquid flow is bad or the capsule outlet can be blocked. For example, plastic membranes like extruded polypropylene (PP) films make long tears that are uncontrollable in dimension and orientation. Hence, the presently disclosed and/or claimed inventive concept(s) aims to provide an aluminum-free membrane which can be controllably opened by relief elements of an opening wall of the capsule.

The presently disclosed and/or claimed inventive concept(s) has other objects and particularly provides the solution to other problems as will appear in the rest of the present description.

BRIEF DESCRIPTION OF THE DRAWINGS

Further details, objects and advantages of the presently disclosed and/or claimed inventive concept(s) will become evident for a skilled person when reading the following detailed explanations of embodiments of the presently disclosed and/or claimed inventive concept(s) when taking in conjunction with the figures of the enclosed drawings.

DETAILED DESCRIPTION

Figure 1:
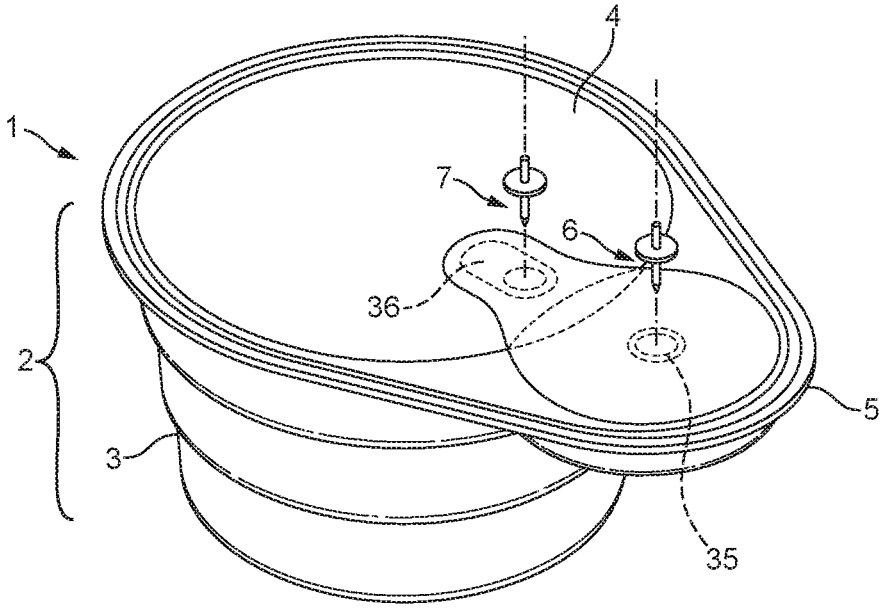
FIG. 1 shows a perspective top view of a capsule according to an embodiment of the presently disclosed and/or claimed inventive concept(s).

In a first aspect, the presently disclosed and/or claimed inventive concept(s) relates to a capsule for preparing a nutritional product (in the following also referred to as "product", "composition" or "nutritional composition"), like an infant formula or a beverage, in a device adapted to supply liquid to the capsule. Such a device can be a liquid supplying device and, in certain non-limiting embodiments, a beverage production machine. The liquid can be any liquid required for producing the nutritional product, such as (but not limited to) water and, in a particular (but non-limiting) embodiment, heated water. The liquid can be introduced or injected into the capsule under pressure. The capsule comprises at least one compartment for providing nutritional ingredients for the preparation of the nutritional product in combination with the supplied liquid. A liquid-tight or liquid impermeable membrane is provided in the capsule to form a release side of the nutritional compartment of the capsule for release of the nutritional product from the capsule. At least one relief element protruding from an opening wall of the capsule and is provided adjacent or close to the liquid impermeable membrane and configured to pierce the liquid impermeable membrane.

The piercing of the liquid impermeable membrane can be obtained by relative deformation of the membrane against one or a plurality of relief elements. The deformation can be obtained by the pressure of liquid rising inside the compartment and/or by mechanical force applied onto the relief elements. In certain non-limiting embodiments, the piercing of the liquid impermeable membrane is obtained by the liquid impermeable membrane bulging toward the outlet such as due to liquid being supplied into the compartment (e.g. due to an increase of the pressure inside the compartment when injecting the liquid into the compartment or during preparation (i.e. dissolution/extraction) of the nutritional product). The liquid impermeable membrane is free of aluminium layer and comprises at least a first polymer layer and a second polymer layer being connected (e.g. laminated) to each other at their surface of contact. The first polymer layer comprises at least one precut, and in certain non-limiting embodiments comprises a plurality of precuts. The second polymer layer is free of precut or weakened line or zone. The relief element is positioned in axial adjacency with at least one portion of the precut or in close axial proximity to the precut.

The term "attached" or "connected to each other" means that the at least two layers of the membrane are connected to each other substantially over their entire (opposed) surfaces of contact facing each other, e.g. by sealing, lamination or gluing.

According to the presently disclosed and/or claimed inventive concept(s) there is provided a multilayered polymer membrane having at least two layers being attached, i.e., laminated, glued or otherwise adhered to each other at their contact surfaces. Having only one of these two polymer layers being precut, the relief element pierces the second polymer layer at a localized opening initiation point depending on the relative location of the relief element with respect to the precut. After the opening initiation has taken place, the second polymer layer continues to tear, such as by effect of pressure building in the compartment, while the tearing remains under control thanks to the presence of the precut in the first polymer layer. The opening initiation performed by the relief element in the second polymer layer may be a full perforation through the whole thickness of the layer or a partial perforation through a partial thickness of the layer but making a sufficient weakening of the layer to enable the tearing along the precut to be obtained. Therefore, the size and shape of the opening, e.g., tearing, of the membrane (or in particular of the second polymer layer) can be defined essentially by the size and shape of the precut formed in the first polymer layer connected of the second polymer layer. The proper opening initiation can be determined by the relative axial position of the precut with respect to the relief element thus enabling the relief element to, in certain non-limiting embodiments, only pierce the non-precut polymer layer. A reasonably low force is required for opening the membrane while at the same time an accurate opening is obtained by properly controlling the tearing of the second polymer layer.

In a particular (but non-limiting) embodiment, the polymer layers of the membrane are made of different polymer materials and/or polymers having different relative or absolute mechanical properties. In certain non-limiting embodiments, the first polymer layer is PET (polyethylene terephthalate) or PA (polyamide). In certain non-limiting embodiments, the second polymer layer is PP (polypropylene), such as (but not limited to) bi-oriented PP. In certain non-limiting embodiments, the membrane is produced by laminating a (for example but not by way of limitation very thin) first polymer layer such as (but not limited to) made of PET or PA on the second polymer layer such as (but not limited to) made of PP. In certain non-limiting embodiments, the second polymer layer is chosen to be also heat sealable on a side opposite to the first polymer layer in order to be sealed on the body of the capsule, e.g., on an annular edge of the bottom of the body of the capsule.

In a particular (but non-limiting) embodiment, the first polymer layer has a puncture breaking load (according to standard ISO3036) that is higher than the puncture breaking load of the second polymer layer. In a more particular (but non-limiting) embodiment, the first polymer layer has a puncture breaking load (according to ISO3036) that is at least 1.5 times, such as (but not limited to) at least two times higher than the puncture breaking load of the second polymer layer. For instance, the first polymer layer can have a breaking load of more than 5 N and the second polymer layer can have a breaking load of less than 3 N (i.e. similar to aluminum). The first polymer layer can have an elongation at break (according to EN ISO527) being higher than the elongation at break of the second polymer layer. In a more particular (but non-limiting) embodiment, the first polymer layer has an elongation at break (according to EN ISO527) which is at least twice, and in a certain non-limiting embodiment, at least five times higher than the elongation at break of the second polymer layer. For instance, the first polymer layer can have an elongation at break of more than 10 mm, such as (but not limited to) more than 30 mm, or between 31 and 60 mm, and the second polymer layer can have an elongation at break of less than 10 mm, such as (but not limited to) less than 5 mm, or between 1 and 5 mm. The first polymer layer can have an energy to peak (according to EN ISO527) being higher than the energy to peak of the second polymer layer. In a particular (but non-limiting) embodiment, the first polymer layer can have an energy to peak at least 5 times, such as (but not limited to) at least 10 times higher than the energy to peak of the second polymer layer. In particular, the first polymer layer can, for instance, have an energy to peak of more than 500 N*mm, such as (but not limited to) between 500 and 850 N*mm, and the second polymer layer can have an energy to peak of less than 50 N*mm, such as (but not limited to) between 5 and 50 N*mm. The first polymer layer can have a thickness between 5 and 80 microns, such as (but not limited to) between 5 and 30 microns, or between 2 and 10 microns. On the other hand, the second polymer layer can have a thickness between 2 and 50 microns, such as (but not limited to) between 5 and 20 microns. In a particular (but non-limiting) embodiment, the second polymer layer has similar mechanical puncture properties like a corresponding aluminum membrane, e.g. an elongation at break of about 1 mm and a breaking load of about 2 N. Hence, mechanical breaking properties comparable to an aluminum membrane can be obtained will also allowing for a highly accurate tear of the liquid impermeable membrane due to the precut and fixed connection.

Therefore, the advantages described above can be obtained by a relatively thin liquid impermeable membrane. It is also possible to provide a membrane which, in respect of certain of its mechanical characteristics, such as its elongation at break and breaking load, behaves similarly to an existing aluminum membrane so that the system, e.g., capsules and/or machines, does not need to be further modified or adapted when using the capsule of the presently disclosed and/or claimed inventive concept(s).

In a particular (but non-limiting) embodiment, the precut in the first polymer layer is configured such that it can act as a valve in association with the second polymer layer once the precut has partially or totally opened (e.g., torn); i.e. the opening in the membrane automatically recloses after release of the nutritional product and/or when the pressure of liquid in the compartment is sufficiently lowered. Particularly, in certain non-limiting embodiments, the precut has a rectilinear slit or a cross-shaped slit. Hence, after the second polymer layer has been pierced and an opening has thus been provided in the membrane, such as by tearing of the second polymer layer along the precut, the nutritional product, such as obtained by dissolution of injected liquid and ingredients (e.g., powder) in the compartment, can leave the capsule while at the end of the nutritional product dispensing process, the precut in the first polymer layer, in association with the second polymer layer, can act as a self-closing valve to prevent dripping of residues out of the compartment when liquid pressure inside the compartment has sufficiently dropped.

In a particular (but non-limiting) embodiment, the precut has a length of about between 2 and 20 mm, such as (but not limited to) 6 mm, and a width of about between 0.05 and 0.5 mm, such as (but not limited to) 0.1 mm.

In certain non-limiting embodiments, the liquid impermeable membrane comprises a plurality of precuts. In certain non-limiting embodiments, the capsule also comprises a plurality of relief elements positioned in axial coincidence or in close proximity with one or more of the precuts.

In certain non-limiting embodiments, the plurality of precuts are uniformly and, in a particular (but non-limiting embodiment, are equidistantly disposed or distributed on the liquid impermeable membrane. In certain non-limiting embodiments, the precuts are distributed in a series of parallel arrays. In certain non-limiting embodiments, the neighboring precuts in the same array are distanced to each other by a distance comprised between 0.5 and 5 mm, such as (but not limited to) between 1.0 and 4.0 mm, or by about 3 mm, respectively. In certain non-limiting embodiments, the precuts of two neighboring arrays are distanced from a distance comprised between 1 and 5 mm, such as (but not limited to) 1.0 and 4 mm, or about 3 mm. In a particular (but non-limiting) embodiment, all or some of the precuts have substantially the same or identical dimensions. The indicated dimensions of the precut are preferred (but not by way of limitation) for more efficiently achieving the function of the membrane in respect of the piercing/opening operations as well as its function as a valve.

The precuts can be provided on the liquid impermeable membrane, i.e., in the first polymer layer, such that a free end of the precut when seen in a plane of the liquid impermeable membrane (i.e. a slit corner in top view) faces axially the relief element. In a particular (but non-limiting) embodiment, a sharp tip of the relief element is positioned axially facing one end portion of the precut. Such positioning enables to initiate the piercing of the precut at one of its ends; such piercing then being able to enlarge e.g., by tearing, towards and up to the opposite end of the precut. As a result, a complete opening along the precut can be successfully achieved in a controlled manner. In another mode, the precuts can be provided on the membrane such that two or more of the ends of the precuts when seen in a plane of the membrane face axially piercing elements, in particular sharp tips of the relief elements. As a result, an opening initiation is enabled at different ends of the second polymer layer with respect to each precut.

According to a particular (but non-limiting) embodiment, the liquid impermeable membrane is provided in the capsule such that the first polymer layer, in which the precut(s) is/are made, is provided on the internal side of the compartment and the second polymer layer is provided on the external side of the compartment. Hence, the second polymer layer to be pierced is directed towards the relief elements to ensure the piercing in a desired fashion without (unduly) interfering with (e.g., damaging or deforming) the precut first polymer layer.

In an alternative, the liquid impermeable membrane is provided in the capsule such that the first polymer layer is provided on the external side of the compartment and the second polymer layer is provided on the internal side of the compartment. Hence, the second polymer layer is pierced once the relief element(s) has/have traversed the precut of the first polymer layer ('vice versa' alternative).

The capsule can comprise an additional liquid impermeable membrane for closing an inlet side of the compartment. Hence, a liquid-tight compartment can be provided. This also allows for an easy injection of the liquid into the compartment by simply piercing the inlet membrane by an injection device (e.g. a liquid injection needle or the like).

In certain non-limiting embodiments, the capsule can comprise a body, such as (but not limited to) made of injected or thermoformed polymer, partially delimiting the compartment and comprising a product outlet. In certain non-limiting embodiments, the additional liquid impermeable membrane is sealed onto the body, such as on an outwardly protruding flange for closing the inlet side of the compartment. The liquid impermeable membrane forming the release side can be sealed onto an inner circumferential edge of the body to close the compartment of the capsule upstream the product outlet. The product outlet can comprise a single or a plurality of product orifices, such as (but not limited to) circumferentially prolonged by a duct to guide the exit flow of nutritional product.

The body and/or liquid impermeable membranes can be substantially gas impermeable to confer a prolonged shelf life to the capsule.

In another aspect, the presently disclosed and/or claimed inventive concept(s) relates to a method for preparing a nutritional product in a corresponding production device. The method comprises the following steps: placing a capsule according to the presently disclosed and/or claimed inventive concept(s) in a receiving chamber of the production device, supplying a liquid into the compartment to be mixed with the ingredients to produce a nutritional product, forcing the liquid impermeable layer against the at least one relief element of the capsule such that the second polymer layer is pierced in a region of the precut of the first polymer layer and an opening is created in the liquid impermeable layer by further tearing of the second polymer layer along at least a portion of the precut, and releasing the prepared nutritional product from the compartment and via the opening in the liquid impermeable layer and the outlet of the capsule out of the capsule. In certain non-limiting embodiments, the opening in the liquid impermeable membrane which is initially pierced into the second polymer layer conforms in size with the precut in the first polymer layer or is smaller than the precut.

In another aspect, the presently disclosed and/or claimed inventive concept(s) also relates to a membrane for use in the manufacture of a capsule for preparing a nutritional product, the membrane is free of aluminium layer and comprises a first polymer layer and second polymer layer being attached to each other at their contact surfaces and the first layer comprises a plurality of precuts and the second layer being free of precut or weakened line or zone and wherein each precut is formed as a rectilinear slit or a cross-shaped slit and each slit having a length, in a particular non-limiting embodiment, between 2 and 20 mm, such as (but not limited to) 6 mm, and a width, in a particular non-limiting embodiment, between 0.05 and 0.5 mm, such as (but not limited to) 0.1 mm. In certain non-limiting embodiments, the plurality of precuts are uniformly and equidistantly distributed on/over the liquid impermeable membrane and the precuts are, in a particular non-limiting embodiment, distanced to each other by a distance between 0.5 and 5 mm, such as (but not limited to) 3 mm, respectively.

In certain non-limiting embodiments, the first polymer layer is made of PET or PA and has, in a particular (but non-limiting) embodiment, a thickness between 5 and 80 μm, such as (but not limited to) between 10 and 30 μm and wherein the second polymer layer is made of PP, such as (but not limited to) bi-oriented PP and has, in a particular non-limiting embodiment, a thickness between 2 and 50 μm, such as (but not limited to) between 5 and 20 μm.

The polymer layers are made of different polymer materials and/or polymer materials having different mechanical characteristics. In certain non-limiting embodiments, the breaking load of the first polymer layer having the precut is higher than the breaking load of the second polymer layer which is free of precut or weakened line or zone.

The terms "pierce", "piercing", "pierceable" or "pierced", "perforate", perforating", "perforable" or perforated" are to be understood in the broad sense as related to an opening obtained by piercing, tearing, perforating or puncturing.

By definition, when ranges of values are given in the present description using the terms "between . . . and", the value limits are included within the given range.

The general aspect of the capsule according to an embodiment of the presently disclosed and/or claimed inventive concept(s) is illustrated in connection with FIGS. 1 to 8 given as a particular (but non-limiting) example only.

The capsule 1 comprises at least one compartment 13 for providing nutritional ingredients 14 for the preparation of the nutritional product in combination with the supplied liquid. The capsule 1 may generally comprise a body 2 for receiving the nutritional ingredients 14, and in a particular (but non-limiting) embodiment, a filter unit for removing contaminant from the liquid supplied to the compartment, and a product delivery system as will be discussed herein below. The compartment 13 may be provided in a cup 3 which is formed in the body 2.

The capsule 1, such as (but not limited to) the body 2, compartment 13 or cup 3 is closed, in certain non-limiting embodiments, by a liquid impermeable top membrane or foil 4 which can be sealed onto a flange-like rim 5 of the capsule 1 or body 2. Hence, an inlet of the capsule 1 can be easily closed by the membrane 4. The membrane 4 may be simply liquid impermeable or, in certain non-limiting embodiments, liquid and gas impermeable. In particular, the membrane 4 can be a multilayer comprising a gas barrier such as EVOH. As will be explained in more detail herein below, the top membrane 4 is made of a puncturable material such as thin polymer to enable liquid, such as water, to be supplied into the capsule 1, e.g., by means of a liquid injector 6 of a device like a liquid supply device or beverage production device. In a particular (but non-limiting) embodiment, the top membrane 4 can be further configured such that it enables gas, like air, to be supplied in the capsule by means of a gas injector 7. In certain non-limiting embodiments, the top membrane 4 is sealed around the liquid inlet and gas inlet by seals 35, 36.

The capsule 1 further comprises a product outlet 9 for release of the (liquid) nutritional composition or product from the capsule 1. In certain non-limiting embodiments, the outlet 9 is provided in/at a bottom 8 of the cup 3. The product outlet 9 may comprise one or several openings for streaming of the composition towards a receptacle, such as a baby bottle, glass or cup. The product outlet 9 may extend from the cup bottom 8 by a short duct 10 for directing the flow of the nutritional product and reducing side projections of liquid which could contaminate the surroundings of the receptacle.

In certain non-limiting embodiments, the body 2 is made of plastic like polymer and encloses the compartment 13 and comprises the outlet 9 and its inlet is, in certain non-limiting embodiments, covered by the membrane 4.

The body 2 of the capsule 1 may extend on the upper side by an extension portion 11 which receives a filter unit 18 for filtering liquid supplied to the capsule 1. In particular, the filter unit 18 can be configured to be insertable/inserted in a filter receiving seat 19 formed at the extension portion 11 of the body 2. The filter receiving seat 19 may be, for instance, a U-shaped cavity of relatively low depth (d) compared to the depth (D) of the compartment. The seat 19 has a bottom wall and a sidewall matching at least part of the bottom and sidewall of the filter unit 18. The filtration is carried out to remove contaminants including microorganisms such as bacteria, yeast or molds and eventually viruses, but also small solid particles potentially contained in liquid. The filter can be formed as a relatively rigid filter unit comprising a flexible micro-porous membrane encased in relatively rigid casing. Such a filter unit 18 is well described in WO2010/128028 filed on 4 May 2010. However, if a filter technology is present in the capsule 1, it is not necessarily limited to the described filter unit 18 but can be any kind of filter (e.g. filter paper) or filter system known in the art. The filter can also be omitted in the capsule 0*f* the presently disclosed and/or claimed inventive concept(s).

Figure 2:
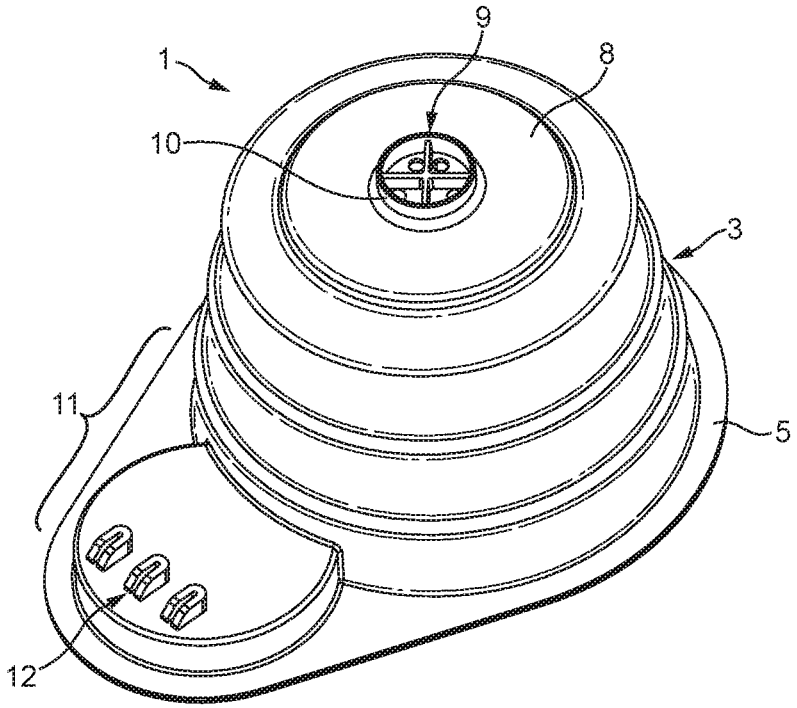
FIG. 2 shows a perspective bottom view of the capsule of FIG. 1.
Figure 3:
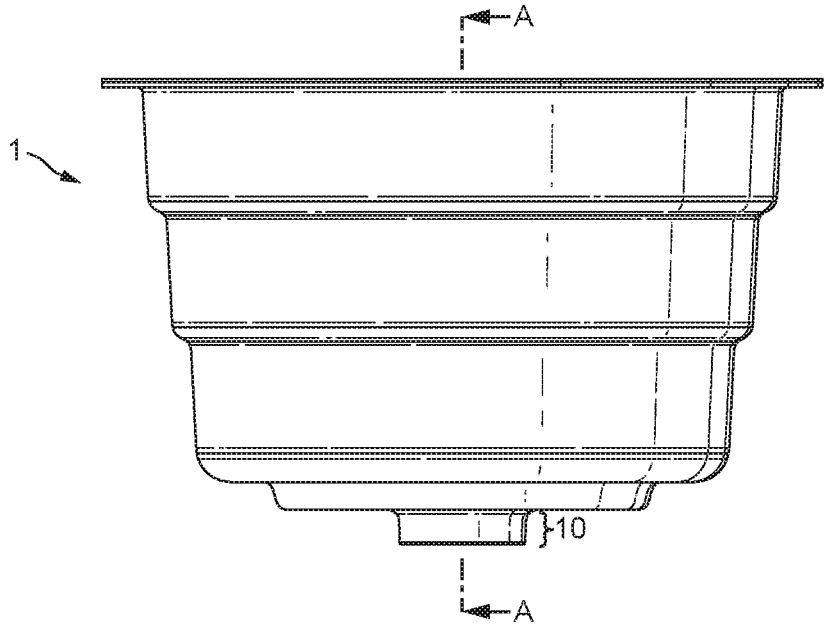
FIG. 3 shows a side view of the capsule of FIG. 1.

As illustrated in FIG. 2, the capsule 1 may further comprise a three-dimensional coding structure 12 capable of co-acting with positioning sensors of the device, for discriminating the type of the capsule 1 inserted in the device so that the preparation cycle may be tailored to the recognized capsule type, e.g., by supplying the proper volume of liquid, varying temperature control, flow rate, etc. Other coding means can be envisaged such as a barcode, RFID tag or an electromagnetic element.

Figure 4:
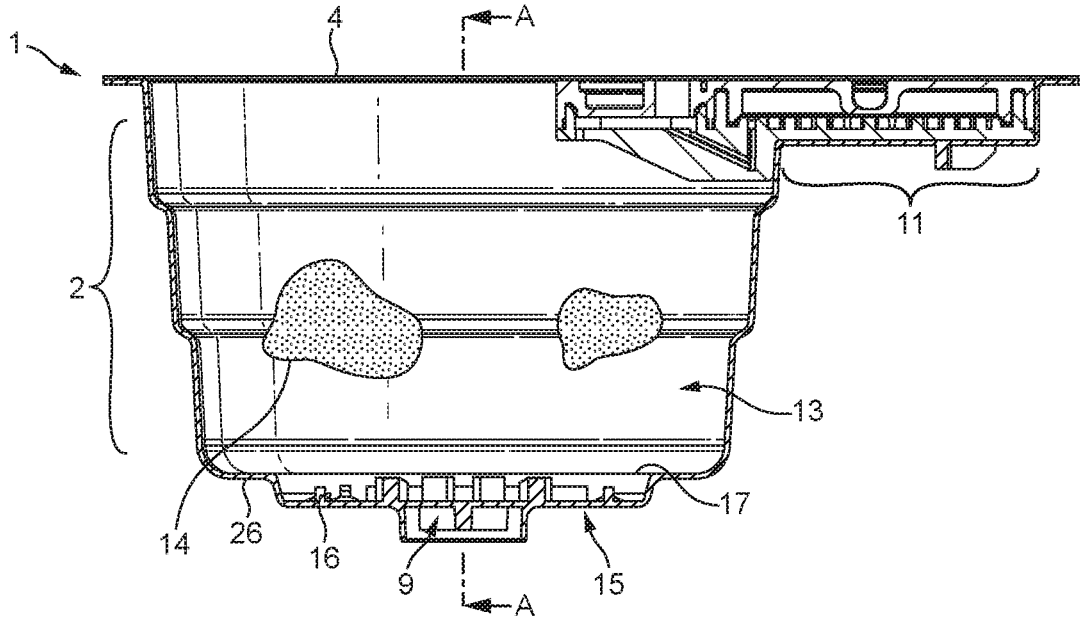
FIG. 4 shows a cross section of the capsule of FIG. 3 along line A-A.
Figure 5:
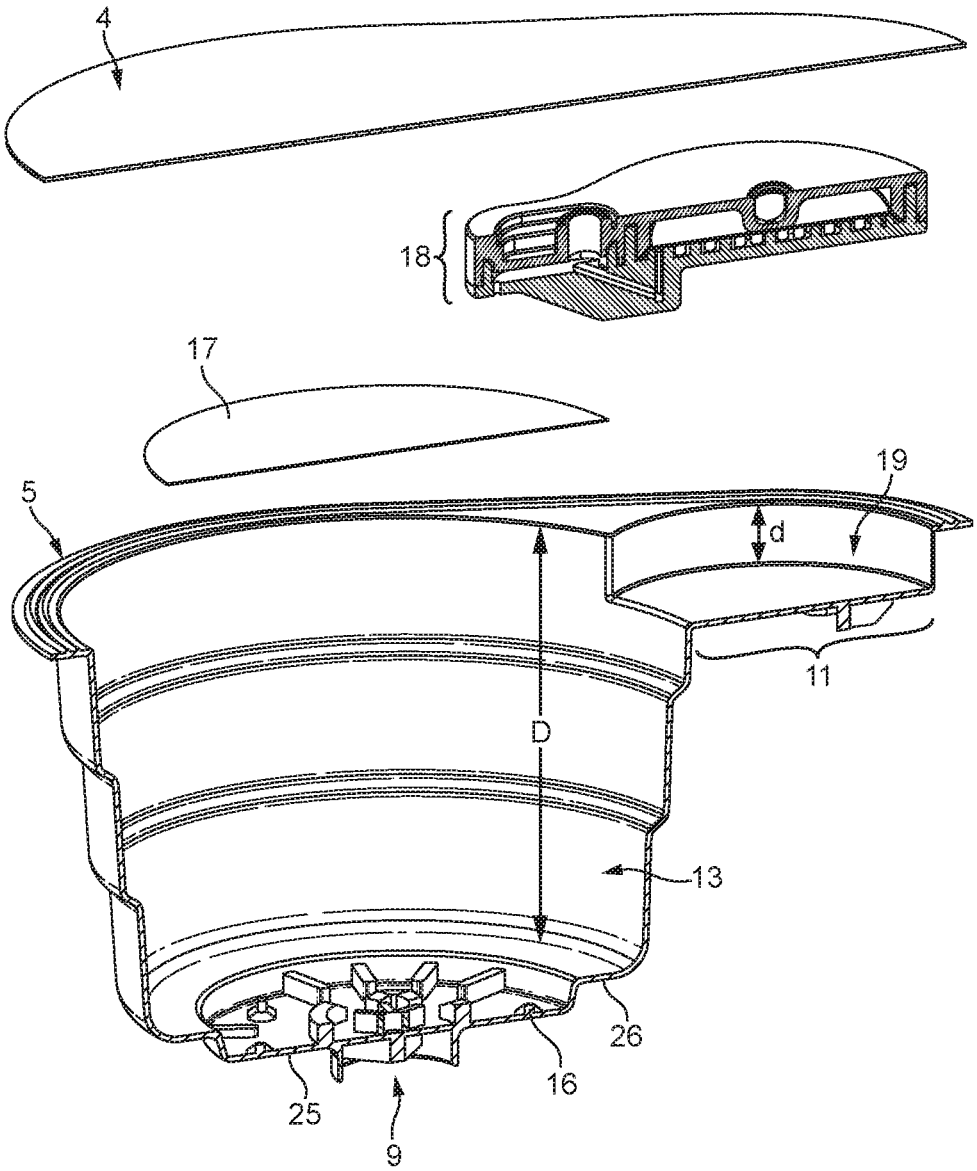
FIG. 5 shows an exploded cross-sectional view of the capsule of FIG. 1 showing the different elements before assembly.
Figure 6:
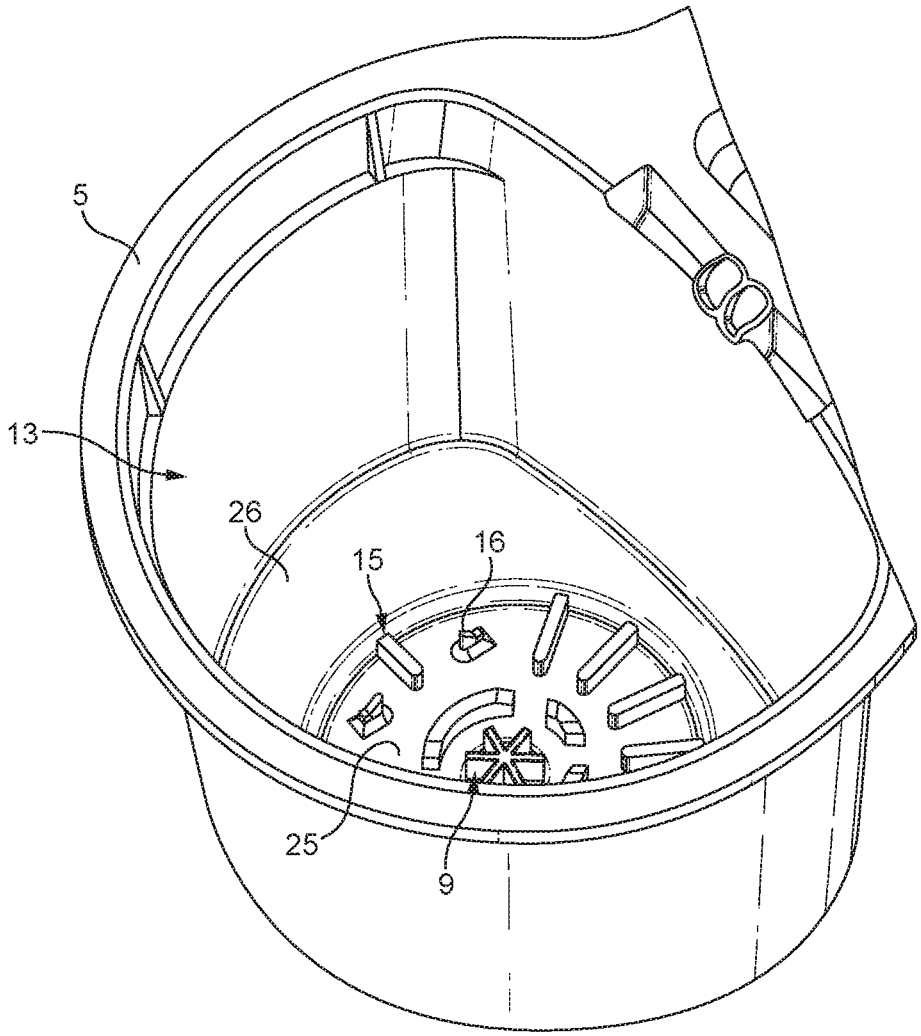
FIG. 6 shows a simplified (i.e. simplified capsule body design) partial perspective top view of the capsule of FIG. 1 without inlet membrane, ingredients and liquid impermeable membrane according to the presently disclosed and/or claimed inventive concept(s).
Figure 7:
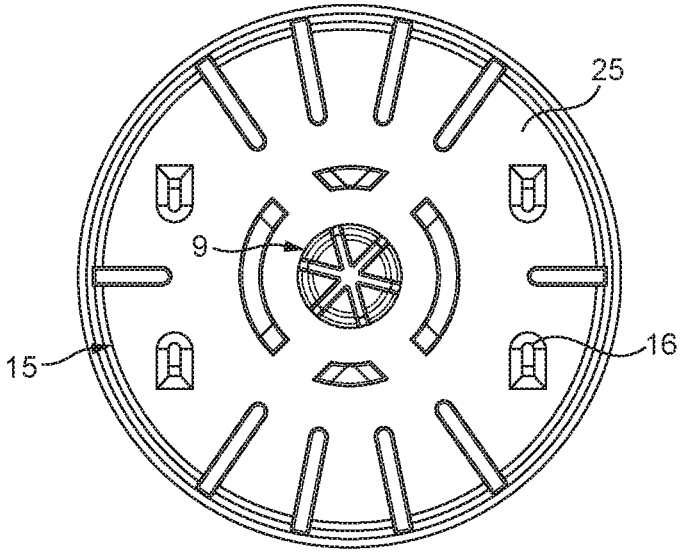
FIG. 7 shows a top view on the product delivery system of the capsule of FIG. 6.

According to FIGS. 4 and 5, the compartment 13 containing the nutritional ingredients 14 is formed by the bottom and sidewall of the cup 3. The volume of the compartment 13 may vary depending on the volume of liquid to be injected in. In general, a large volume is preferred (but not by way of limitation) for large volume of liquid so that the compartment serves as a mixing bowl for the ingredients and liquid to form the nutritional product.

Figure 8:
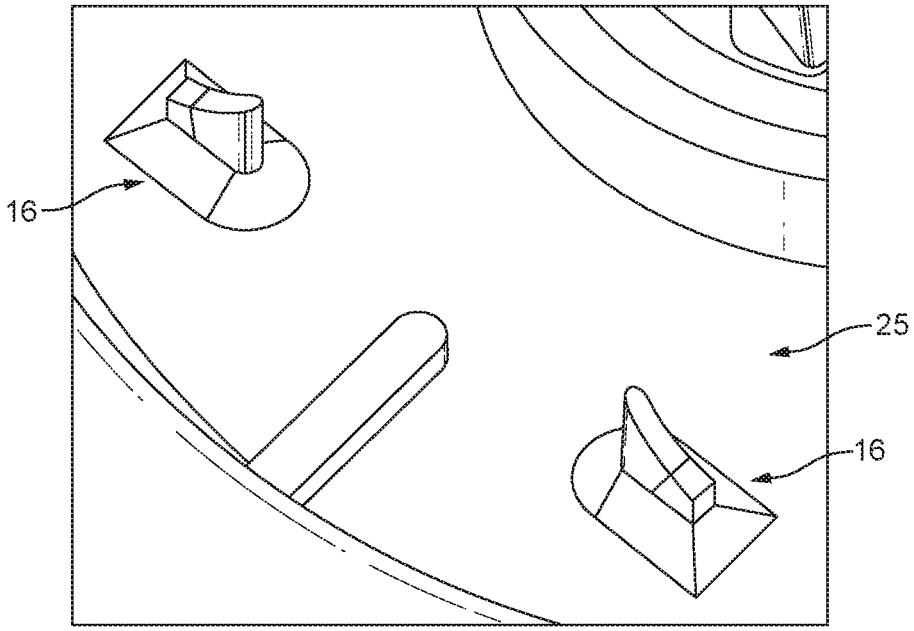
FIG. 8 shows an enlarged perspective view of the relief elements of the capsule of FIG. 6.
Figure 9:
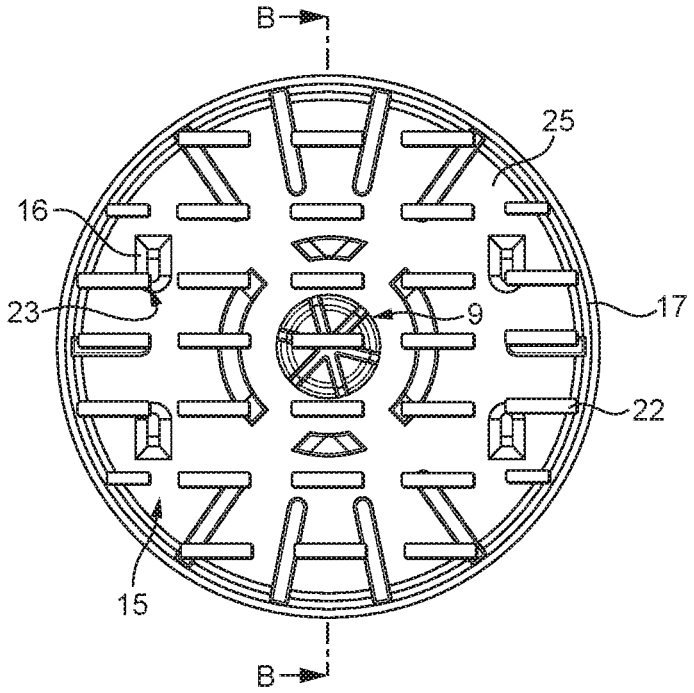
FIG. 9 shows a top view on the product delivery system of FIG. 7 being covered by the liquid impermeable membrane according to an embodiment of the presently disclosed and/or claimed inventive concept(s).
Figure 10:
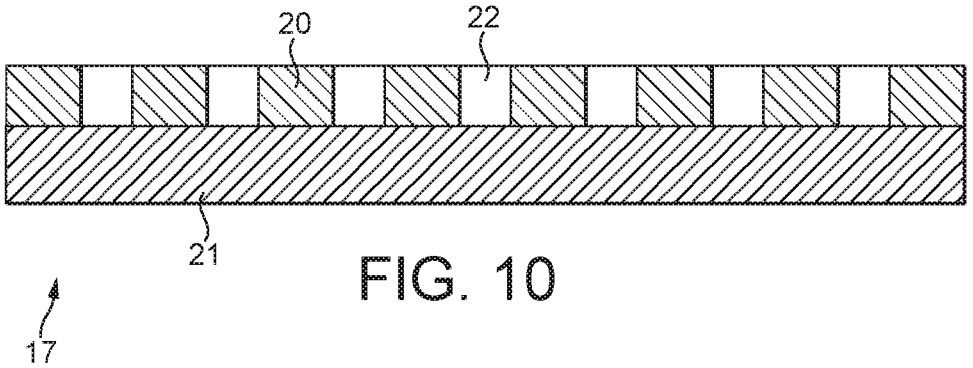
FIG. 10 shows a schematic cross section of the liquid impermeable membrane according to the presently disclosed and/or claimed inventive concept(s) of FIG. 9 along line B-B.

The capsule 1 may comprise a product delivery system 15 for ensuring a proper interaction of the supplied liquid and the ingredients 14 contained in the compartment 13 of the capsule 1 and for reducing, and in certain non-limiting embodiments avoiding, contact of nutritional product with the device. In a particular mode, the product delivery system 15 is designed to open at least one orifice through the capsule 1 for delivery of the composition when a sufficient pressure of liquid has been reached in the compartment 13. For this, capsule 1 such as (but not limited to) the bottom 8 of the cup 3—comprises at least one or a plurality of perforating or relief elements 16 forming piercing means strategically placed (see, for instance, FIGS. 7 to 9) to perforate a lower membrane 17 separating the compartment 13 from the liquid product outlet 9. The relief elements 16 forms part of an opening wall 25, forming (in certain non-limiting embodiments) at least part of the bottom 8 of the capsule. The relief elements 16 protrude in direction of the compartment. It should be noted that the opening wall could be a piece separate from the bottom 8 such as an inserted disc. The relief elements 16 are configured such that they perforate the membrane 17 in case the membrane 17 is deformed relative to the relief elements, for example bulges toward the bottom 8 or outlet 9; e.g. due to the liquid being supplied into the compartment 13 when exceeding a predetermined pressure inside the capsule 1. The relief element 16 may be shaped a cutting tooth. The tooth may comprise a tip formed by a slanted surface intersected by a U-shaped base surface extending orthogonally relative to the plane of the membrane. In certain non-limiting embodiments, the tooth is oriented relative to the precut such that its slanted surface extends perpendicularly to the precut with the tip being at the limit or inside the precut, such as (but not limited to) one free end of the precut. The relief element can have other various shapes such as a cylindrical, conical, cubical or pyramidal base surface intersected by a slanted surface. Deformation of the membrane relative to the relief element could be obtained by other means such as by inward deformation of the bottom 8 of the capsule exerted by an external mechanical action (e.g., exerted by the capsule holder on the capsule during closure of the device). An example of a particular (but non-limiting) piercing design is shown in FIG. 8. However, the presently disclosed and/or claimed inventive concept(s) is not limited to the exemplary design.

A capsule comprising such a product delivery system 15 is described in WO 20090115475 filed on 16 Mar. 2009. It should be noted that the product delivery system 15 can also be designed differently.

The membrane 17 is a (thin) liquid impermeable (i.e. liquid-tight) and perforable membrane. In a particular (but non-limiting) embodiment, the liquid impermeable membrane 17 is also substantially gas impermeable. In certain non-limiting embodiments, the membrane 17 is sealed at the bottom of the capsule 1, such as (but not limited to) at an inner bottom edge 26 of the cup 3. The liquid impermeable membrane 17 is only made of polymer layers comprising at least a first polymer layer 20 and a second polymer layer 21 being laminated to each other. Therefore, in certain non-limiting embodiments, the second polymer layer 21 is heat sealable on a side opposite to the first polymer layer 20 in order to be sealed on the corresponding capsule bottom portion.

According to a particular (but non-limiting) embodiment, the polymer layers 20, 21 are made of different polymer materials. The first polymer layer 20 can, for instance, be made of PET or PA. According to a particular (but non-limiting) embodiment, the first polymer layer 20 has a thickness of 5-80 μm, such as (but not limited to) 5-30 μm. The second polymer layer 21, can, for instance, be made of PP, such as (but not limited to) bi-oriented PP. According to a particular (but non-limiting) embodiment, the second polymer layer 21 has a thickness of 2-50 μm, such as (but not limited to) 5-20 μm.

The first polymer layer 20 has a puncture break load that is higher than the puncture break load of the second polymer layer 21. In a particular (but non-limiting) embodiment, the first polymer layer has a puncture breaking load that is at least 1.5 times, such as (but not limited to) at least two times higher than the puncture breaking load of the second polymer layer. For instance, the first polymer layer can have a breaking load of more than 5 N and the second polymer layer can have a breaking load of less than 3 N.

For measuring the puncture breaking load, according to International Standard ISO3036, the samples of films formed of the polymer material of each layer were tested by a puncture tester. The tester is typically designed as a pendulum with a head to measure the energy required to puncture the film. Generally, a puncture head consisting of stainless steel is attached to a solid arm. The arm under load swings through an arc until it contacts the sample clamped between two horizontal plates. The upper plate is fixed while the lower is spring loaded. Each has a triangular hole to accommodate the puncture head. A collar loosely fitted to the cylindrical extension to the puncture head, detaches after penetration and adheres to the sample, keeping the hole open and preventing and breaking action of the pendulum. The samples had a length and width of 15 mm. The speed of the pendulum was 10 mm/min. The applied load was 10 N. The tests were repeated at least 5 times and the results were averaged.

In certain non-limiting embodiments, the first polymer layer 20 has a breaking load being higher than the breaking load of the second polymer layer 21. For instance, the first polymer layer 20 can have a breaking load of more than 10 N and the second polymer layer can have a breaking load of less than 5 N. The first polymer layer 20 can have an elongation at break being higher than the elongation at break of the second polymer layer 21. For instance, the first polymer layer 20 has an elongation at break of more than 10 mm and the second polymer layer 21 has an elongation at break of less than 1 mm.

For measuring the elongation at break according to International Standard EN ISO527, the samples of films made of the polymer material of each layer were tested in an extensometer. The samples had a length of 100 mm and a width of 15 mm. The speed of the extensometer was chosen at 50 mm/minute. The applied load was 100 N. The tests were repeated at least 5 times and the results were averaged.

According to the presently disclosed and/or claimed inventive concept(s), only the first polymer layer 20 of the first and second polymer layers 20, 21 comprises at least one precut 22 in a region of the liquid impermeable membrane 17 opposing the relief element 16. With respect to the exemplary embodiment of FIG. 9, the membrane 17 comprises 31 precuts while at least one (actually 4 precuts as illustrated in the figure), of the precuts 22 is placed in a region of the liquid impermeable membrane 17 in axial adjacency with a relief element 16. The direction of the axis for determining the adjacency of the precut relative to the relief element is here considered as a perpendicular direction relative to the membrane. When having a plurality of precuts 22, the precuts 22 are in certain non-limiting embodiments, uniformly and in particular (but non-limiting) embodiments equidistantly distributed on/over the liquid impermeable membrane 17. In certain non-limiting embodiments, the precuts 22 are distanced to each other by 0.5-5 mm, such as (but not limited to) 3 mm, respectively.

In certain non-limiting embodiments, the precut 22 has a length of 2-20 mm, such as (but not limited to) 6 mm, and a width of 0.05-0.5 mm, such as (but not limited to) 0.1 mm. In a particular (but non-limiting) embodiment, the precut 22 in the first polymer layer 20 is configured in association with the second polymer layer for acting as a valve once the second polymer layer 21 has been perforated by the relief element 16. This means that the precut provides an automatic self-reclosing function, e.g. due to the elasticity of the membrane material in combination with the laminated layers 20, 21. The reclosing function is effective when the pressure inside the capsule drops sufficiently after draining of the majority of the liquid inside the capsule and to prevent a final dripping. In certain non-limiting embodiments, the precut 22 has a rectilinear or a cross shaped slit layout.

In a particular (but non-limiting) embodiment, the precut(s) 22 is/are provided on the liquid impermeable membrane 17 such that an free end 23 of the respective precut 22 (e.g. when seen in a plane of the liquid impermeable membrane 17 or in top view on the membrane 17 or precut 22) faces the relief element 16.

According to a particular (but non-limiting) embodiment of the presently disclosed and/or claimed inventive concept(s), the liquid impermeable membrane 17 is provided in the capsule 1 such that the first polymer layer 20 having the precut(s) 22 is provided on the inner side of the compartment 13 and the second polymer layer 21 is provided on the outer side of the compartment or forms the delivery side of the capsule, i.e. opposite to the compartment with respect to the first polymer layer 20, or is provided on the side of the outlet 9.

It is noted that the membrane 17 alone can also form part of the presently disclosed and/or claimed inventive concept(s). In this respect, a membrane 17 is provided which is only made of polymer layers, comprising at least the first polymer layer 20 and the second polymer layer 21 being laminated to each other, wherein only one of the first and second polymer layers 20, 21 comprises at least one precut 22, such as (but not limited to) a plurality of precuts, wherein the polymer layers 20, 21 are made of different polymer materials, and wherein the breaking load of the first polymer layer 20 having the precut 22 is higher than the breaking load of the second polymer layer 21.

The membrane 17 can, for instance, be produced as follows: a polymer sheet made of the material of the first polymer layer is provided. Then, precuts 22 are provided in the sheet. The precut can be provided by any suitable technology such as punching, stamping, laser cutting or water beam cutting. Then, a second sheet made of the material of the second polymer layer is provided and is attached (e.g. laminated or sealed) onto the precut first sheet. Finally, the membranes 17 are cut (e.g. punched) out of the connected sheet material so that the precuts 22 are provided on the membrane 17 at the desired positions with respect to the capsule 1 design.

In an alternative method, a polymer sheet made of the material of the first polymer layer is provided. Then, a second sheet made of the material of the second polymer layer is provided and is attached (e.g. laminated or sealed) onto the first sheet. Then, precuts 22 are provided in the first sheet such as by laser or mechanical cutting. Finally, the membranes 17 are cut (e.g. punched) out of the connected sheet material so that the precuts 22 are provided on the membrane 17 at the desired positions with respect to the capsule 1 design.

To facilitate the placement of the membrane relative to the relief elements, the precuts are, in certain non-limiting embodiments, provided on the membrane surface area in number that by several times exceeds the required number for each capsule. For example, the number of precuts per capsule can be of about 30 whereas only 2, 3, 4, 5, 6, 7 or 8 of them are positioned in functional relation with the relief elements. In certain non-limiting embodiments, the precuts are distributed along a plurality of longitudinal and transversal arrays with constant distances between two adjacent precuts in both longitudinal and transversal directions. The distance between two adjacent precuts is chosen to facilitate placement of the membrane relative to the relief elements while maintaining a sufficient strength of the membrane against accidental breaking in non-desired areas (outside the regions of the relief elements).

In the follow, a method for preparing a nutritional product in a production device is described. Said method comprises, in a first step, placing a capsule 1 according to the presently disclosed and/or claimed inventive concept(s) in a receiving chamber of the production device. In a second step, a liquid is supplied into the compartment 13 of the capsule 1 to be mixed with the ingredients stored inside the compartment 13 to produce a nutritional product. Due to the liquid being introduced (i.e. injected) into the capsule 1, pressure inside the capsule 1 increases and results in the membrane 17 to bulge toward the at least one relief element 16 of the capsule 1 such that (only) the second polymer layer 21 is perforated in a region of the precut 16 of the first polymer layer 20 to create an opening in the liquid impermeable layer 17. Finally, the prepared nutritional product is released (i.e. drained) from the compartment 13 and via the opening in the liquid impermeable layer 17 and the product outlet 9 from the capsule 1. In a particular (but non-limiting) embodiment, the opening in the liquid impermeable membrane 17 conforms in size with the precut 22 in the first polymer layer 20 or is smaller than the precut 22. This preferably (but not by way of limitation) comes about since only the second polymer layer 21 is perforated in a region of the precut 22 of the first polymer layer 20 so that the opening can open, i.e., tear, in a region of the precut 22 while the lamination of the polymer layers 20, 21 avoids a further tear of the second polymer layer 21 and thus of the membrane 17. Hence, the membrane 17 or precut 22 can be designed such that a valve like function can be obtained to avoid dripping of residues in the capsule 1 after the production process and removal of the capsule 1 out of the machine.

The presently disclosed and/or claimed inventive concept(s) is not limited by the embodiments as described herein above. In particular, the features of the respective embodiments can be combined in any possible way as long as being covered by the appended claims. In the light of the presently disclosed and/or claimed inventive concept(s), "capsules" are to be understood as any kind of ingredient-containing container which can be placed into a device (such as, e.g., a beverage dispensing machine) in order to have a liquid (usually water) enter the interior of the container and which allows for an opening of the capsule at an outlet side due to the liquid introduced on the inlet side, e.g., by a pressure increase within the capsule. The dimensions, polymer materials and their properties given in the presently disclosed and/or claimed inventive concept(s) are only for exemplary purposes while the application is not limited thereto.

The invention claimed is:

1. A capsule for preparing a nutritional product in a device configured to supply liquid into the capsule, the capsule comprising:

at least one compartment for providing nutritional ingredients for the preparation of the nutritional product in combination with the supplied liquid, wherein the at least one compartment comprises a liquid impermeable membrane forming a release side of the at least one compartment, the liquid impermeable membrane configured to release the nutritional product from the at least one compartment, and wherein the capsule further comprises at least one relief element protruding from an opening wall, wherein the at least one relief element is tooth shaped comprising a slanted surface that forms a tip at a first end of the slanted surface, and a second end of the slanted surface is opposite from the first end and is more distant from the liquid impermeable membrane than the tip, wherein the at least one relief element further comprises a base surface connecting the slanted surface to the opening wall, and wherein the at least one relief element comprises a surface perpendicular to the liquid impermeable membrane and extending between the base of the relief element and the tip of the relief element, wherein the liquid impermeable membrane is free of an aluminium layer and comprises a first polymer layer and a second polymer layer being connected to each other at a respective surface of contact, wherein the first polymer layer comprises a precut and wherein the second polymer layer is free of a precut or weakened line or zone, and wherein the relief element is positioned to overlap the precut in an axial direction perpendicular to a plane of the liquid impermeable membrane, the precut positioned such that a first end of the precut overlaps the at least one relief element and a second end of the precut does not overlap the at least one relief element when viewed along the axial direction.

2. The capsule according to claim 1, wherein the first polymer layer has a puncture breaking load higher than a puncture breaking load of the second polymer layer and/or wherein the first polymer layer has an elongation at break higher than an elongation at break of the second polymer layer.

3. The capsule according to claim 1, wherein the first polymer layer comprises polyethylene tetraphthalate or polyamide.

4. The capsule according to claim 1, wherein the first polymer layer has a thickness between 5 and 80 μm.

5. The capsule according to claim 1, wherein the second polymer layer comprises polypropylene.

6. The capsule according to claim 1, wherein the first and the second polymer layers are adhered to each other to be connected to each other at surfaces of contact.

7. The capsule according to claim 1, wherein the precut comprises a rectilinear slit or a cross-shaped slit.

8. The capsule according to claim 7, wherein the precut in the first polymer layer is configured to act as a valve in association with the second polymer layer.

9. The capsule according to claim 1, wherein the precut has a length between 2 and 20 mm and a width between 0.05 and 0.5 mm.

10. The capsule according to claim 1, wherein the liquid impermeable membrane comprises a plurality of precuts which are uniformly and equidistantly distributed on the liquid impermeable membrane.

11. The capsule according to claim 1, wherein the liquid impermeable membrane is positioned in the capsule such that the first polymer layer is positioned on an internal side of the at least one compartment and the second polymer layer is positioned on an external side of the at least one compartment.

12. The capsule according to claim 1, wherein the capsule comprises an additional liquid impermeable membrane positioned to close an inlet side of the at least one compartment.

13. The capsule according to claim 1, wherein the liquid impermeable membrane is gas impermeable.

14. The capsule according to claim 1, wherein the second polymer layer has a thickness between 2 and 50 μm.

15. The capsule according to claim 1, wherein the capsule comprises a body made of injected or thermoformed polymer.

16. The capsule according to claim 1, wherein the capsule comprises a body, the body partially defines the at least one compartment and comprises a product outlet, the liquid impermeable membrane is sealed onto an inner circumferential edge of the body to close the release side of the at least one compartment of the capsule upstream of the product outlet.

* * * * *